US006164327A

United States Patent [19]

Yoshida

[11] Patent Number: 6,164,327

[45] Date of Patent: Dec. 26, 2000

[54] METER-OUT FLOW CONTROL VALVE

[75] Inventor: Nobumi Yoshida, Tochigi, Japan

[73] Assignee: Komatsu Ltd., Tokyo, Japan

[21] Appl. No.: 09/367,320

[22] PCT Filed: Feb. 17, 1998

[86] PCT No.: PCT/JP98/00660

§ 371 Date: Aug. 12, 1999

§ 102(e) Date: Aug. 12, 1999

[87] PCT Pub. No.: WO98/36175

PCT Pub. Date: Aug. 20, 1998

[30] Foreign Application Priority Data

Feb. 17, 1997 [JP] Japan ..... 9-031943

[51] Int. Cl.[7] ..... F15B 13/043

[52] U.S. Cl. ..... 137/596.15; 91/436; 91/446; 91/452; 91/455; 137/596.16; 137/596.2

[58] Field of Search ..... 91/436, 446, 452, 91/455; 137/596.15, 596.16, 596.2

[56] References Cited

U.S. PATENT DOCUMENTS 4,475,442 10/1984 Breeden ..... 91/446 X
4,611,528 9/1986 Nanda et al. ..... 91/455 X
5,372,060 12/1994 Maruyama et al. ..... 91/446 X

FOREIGN PATENT DOCUMENTS 59-92201 6/1984 Japan .
60-37402 2/1985 Japan .
2-8502 1/1990 Japan .
2-283902 11/1990 Japan .

*Primary Examiner*—Gerald A. Michalsky
*Attorney, Agent, or Firm*—Ronald P. Kananen; Rader, Fishman & Grauer

[57] ABSTRACT

A meter-out flow control valve is provided that is compact and possesses a regenerative function. A poppet valve 70 for establishing and blocking fluid communication between a first actuator port 73-1 and a tank port 74 is urged by a spring 71 into a pressure contact with a seat 72. The poppet valve 70 is moved away from the seat 72 under pressure in a first pressure receiving chamber 80-1. A cylindrical valve 103 is fitted with the poppet valve 70 to provide a regenerative switching valve 101 that may establish and block fluid communication between the first actuator port 73-1 and a first regenerative port 100. A meter-out flow control valve having a poppet valve 70 and a cylindrical valve 103 fitted together is thus provided that is compact in form and yet capable of regenerating pressure fluid in a first actuator port 73-1 into a first regenerative port 100.

6 Claims, 11 Drawing Sheets

METER-OUT FLOW CONTROL VALVE

TECHNICAL FIELD

The present invention relates to a meter-out flow control valve for recovering return fluid from a hydraulic actuator to permit the return fluid to be recycled.

BACKGROUND ART

A known directional control valve system for furnishing a hydraulic actuator with pressure fluid includes a meter-in flow control valve for establishing and blocking fluid communication between a pump port and an actuator port, and a meter-out flow control valve for establishing and blocking fluid communication between the actuator port and a tank port.

Such a meter-out flow control valve is designed to allow return fluid in the hydraulic actuator to flow out into a reservoir tank by establishing fluid communication between the actuator port and the tank port and to block fluid communication between the actuator port and the tank port. The return fluid from the hydraulic actuator that has been allowed to flow out into the reservoir tank cannot be recovered for recycling.

It is also known to provide the actuator port with a recovery valve and, using this valve, to recover return fluid from the hydraulic actuator for recycling. Providing a recovery valve in addition to a meter-out flow control valve enlarges a space for installation and, if they are assembled in a valve body of a directional control valve system, enlarges the valve body and requires the entire directional. control valve system to be larger in size.

BRIEF SUMMARY OF THE INVENTION

It is accordingly an object of the present invention to provide a meter-out flow control valve which is designed to resolve the problem mentioned above.

A first form of the invention provided herein is a meter-out flow control valve characterized in that it comprises: a valve for establishing and blocking fluid communication between an actuator port and a tank port, the valve being arranged to be held at a fluid blocking position by a spring 71 and being responsive to an external signal to move to take its fluid communication position; and a regenerative switching valve 101 arranged coaxially with said valve for establishing and blocking fluid communication between the actuator port and a regenerative port, the regenerative switching valve 101 normally taking its blocking position and being responsive to an external signal to move to take its fluid communication position.

According to the first form of the invention described, it can be seen and should be appreciated that the valve if moved to take its fluid communication position permits the actuator port and the tank port to be brought into fluid communication with each other. And, the regenerative switching valve if moved to take its fluid communication position permits the actuator port and the regenerative port to be brought into fluid communication with each other.

This will allow a return fluid admitted into the actuator port to flow out into a reservoir tank, and to flow out into the regenerative port, thus permitting the return fluid where required to be regenerated for recycling.

It should also be noted that arranging the regenerative switching valve 101 coaxially with the valve will make the meter-out flow control compact.

This will, if the meter-out flow control valve is assembled in a valve body of a directional control valve system, render the valve body and the entire system smaller in size.

A second form of the invention provided herein is a meter-out flow control valve characterized in that it comprises: a meter-out spool 130 for establishing and blocking fluid communication between an actuator port and a tank port, the meter-out spool 130 being arranged to be held at its fluid blocking position by. a spring 131 and being responsive to an external signal to move to take its fluid communication position; and a regenerative switching valve 101 arranged coaxially with said meter-out spool 130 for establishing and blocking fluid communication between the actuator port and a regenerative port, the regenerative switching valve normally taking its fluid blocking position and being responsive to an external signal to move to take its fluid communication position.

According to the second form of the invention described, it can be seen and should be appreciated that the meter-out spool 130 if moved to take its fluid communication position permits the actuator port and the tank port to be brought into fluid communication with each other. And, the regenerative switching valve 101 if moved to take its fluid communication position permits the actuator port and the regenerative port to be brought into fluid communication with each other.

This will allow a return fluid admitted into the actuator port to flow out into the reservoir tank and to flow out into the regenerative port, thus permitting the return fluid where required to be regenerated for recycling.

It should also be noted that arranging the regenerative switching valve 101 coaxially with the meter-out spool 130 will make the meter-out flow control compact.

This will, if the meter-out flow control valve is assembled in a valve body of a directional control valve system, render the valve body and the entire system smaller in size.

A third form of the invention provided herein is a meter-out flow control valve according to the first or second form of the invention described in which the said regenerative switching valve 101 is arranged so that a cylindrical valve 103 is urged by a spring 105 into a pressure contact with a seat 106 to take its blocking position, the cylindrical valve 103 is movable away from the seat 106 by pressure fluid in a pressure chamber 104, further comprising means for supplying pressure fluid into said pressure chamber 104.

According to the third form of the invention described, it can be seen and should be appreciated that the cylindrical valve 103 that is urged by the spring 105 into a pressure contact with the seat 106 to take its blocking position will allow the use of a valve of a cone seat type to ensure fluid blocking between the actuator port and the regenerative port.

This will prevent fluid from leaking from the actuator port into the regenerative port.

It should also be noted that the ability to switch the regenerative switching valve 101 into a fluid communication position with pressure fluid supplied into the pressure chamber 104 will make the operation simple and allow the regenerative switching valve 101 to be switched externally.

A fourth form of the invention provided herein is a meter-out flow control valve according to the first form of the invention described in which said regenerative switching valve 101 is arranged so that a cylindrical valve, 103 is urged by a spring 105 into a pressure contact with a seat 106 to take its blocking position, and is movable to take its fluid communication position in response to an external signal for causing a valve to move to take its fluid communication position.

According to the fourth form of the invention described, it can be seen and should be appreciated that causing the cylindrical valve 103 to move to take its fluid communication position with an external signal for causing a valve to move to take its fluid communication position will permit a single external signal to be sufficient and thus make the means for providing the external signal simple.

A fifth form of the invention provided herein is a meter-out flow control valve characterized in that it comprises: a valve body 10 having an actuator port, a tank port and a regenerative port; a meter-out spool 130 slidably received in the valve body; and a spring 131 for holding the meter-out spool 130 at its fluid blocking position that blocks fluid flow for each of said ports, the meter-out spool 130 being arranged to move in response to an external signal to take its fluid communication position that permits fluid flow between the actuator port and the tank port and between the regenerative port and the actuator port.

According to the fifth form of the invention described, it can be seen and should be appreciated that permitting fluid flow between the actuator port and the tank port and between the regenerative port and the actuator port by simply causing the meter-in spool 130 to move to take its fluid communication position will make the structure of the meter-out flow control valve simple.

A sixth form of the invention provided herein is a directional control valve characterized in that it comprises: a meter-in flow control valve 1 for establishing and blocking fluid communication of a pump port with a single outlet port 12; a first load checking valve 3 disposed between said outlet port 12 and a first actuator port 73-1 and adapted to be held in a closed state in response to an external signal; a second load checking valve 3 disposed between said outlet port 12 and a second actuator port 73-2 and adapted to be held in a closed state in response to an external signal, and a meter-out flow control valve 4 comprising a first meter-out flow control valve 4-1 and a second meter-out flow control valve 4-2, the first meter-out flow control valve 4-1 being of a poppet valve type comprising a poppet valve 70 adapted to block fluid communication between the first actuator port 73-1 and a tank port 74 under pressure in the first actuator port 73-1, the said poppet valve 70 being adapted to move in response to an external signal to take its fluid communication position, and a regenerative switching valve 101 disposed on an outer periphery of said poppet valve 70 for establishing and blocking fluid communication between the first actuator port 73-1 and a first regenerative port 100, and the said second meter-out flow control valve 4-2 being of a poppet valve type comprising a poppet valve 70 adapted to block fluid communication between the second actuator port 73-2 and the tank port 74 under pressure in the second actuator port 73-2, the said poppet valve 70 being adapted to move in response to an external signal to take its fluid communication position, and there being arranged on a periphery of this poppet valve 70 a regenerative switching valve 101 for establishing and blocking fluid communication between the second actuator port 73-2 and a second regenerative port 107.

According to the sixth form of the invention described, it can be seen and should be appreciated that arranging the regenerative switching valve 101 on an outer periphery of the poppet valve 70 provides a directional control valve system that is entirely small in size yet with the ability to regenerate fluid from the first, second actuator port 73-1, 73-2 for recycling.

It should also be noted that establishing fluid communication between the pump port of the meter-in flow control valve 1 and the outlet port 12, holding the first load checking valve 2 in a closed state and establishing fluid communication of the first actuator port 72 of the meter-out flow control valve 4 with the first tank port 71 will permit pressure fluid admitted into the pump port to force to open the second load checking valve 3 and thereby to be supplied into the second actuator port 73-2 and pressure fluid in the first actuator port 73-1 in turn to flow out into the tank port 74.

And, establishing fluid communication between the pump port of the meter-in flow control valve 1 and the outlet port 12, holding the second load checking valve 3 in a closed state and establishing fluid communication of the second actuator port 73-2 of the meter-out flow control valve 4 with the tank port 74 will permit pressure fluid admitted into the pump port to force to open the first load checking valve 2 and thereby to be supplied into the first actuator port 73-1 and pressure fluid in the second actuator port 73-2 in turn to flow out into the tank port 74.

Thus, permitting pressure fluid admitted into the pump port to be supplied into the first or second actuator port 73-1 or 73-2 and pressure fluid in the second or first actuator port 73-2 or 73-1 to flow out into the reservoir tank can furnish pressure fluid into a first, a second chamber 99*a*, 99*b* of a hydraulic actuator 99.

It should further be noted that permitting the meter-in flow control valve 1 enough to require no more than two ports, the pump port and the outlet port 12, will make the entire valve system simple in structure.

BRIEF DESCRIPTION OF THE DRAWINGS

.

BEST MODE FOR CARRYING OUT THE INVENTION

Figure 1:
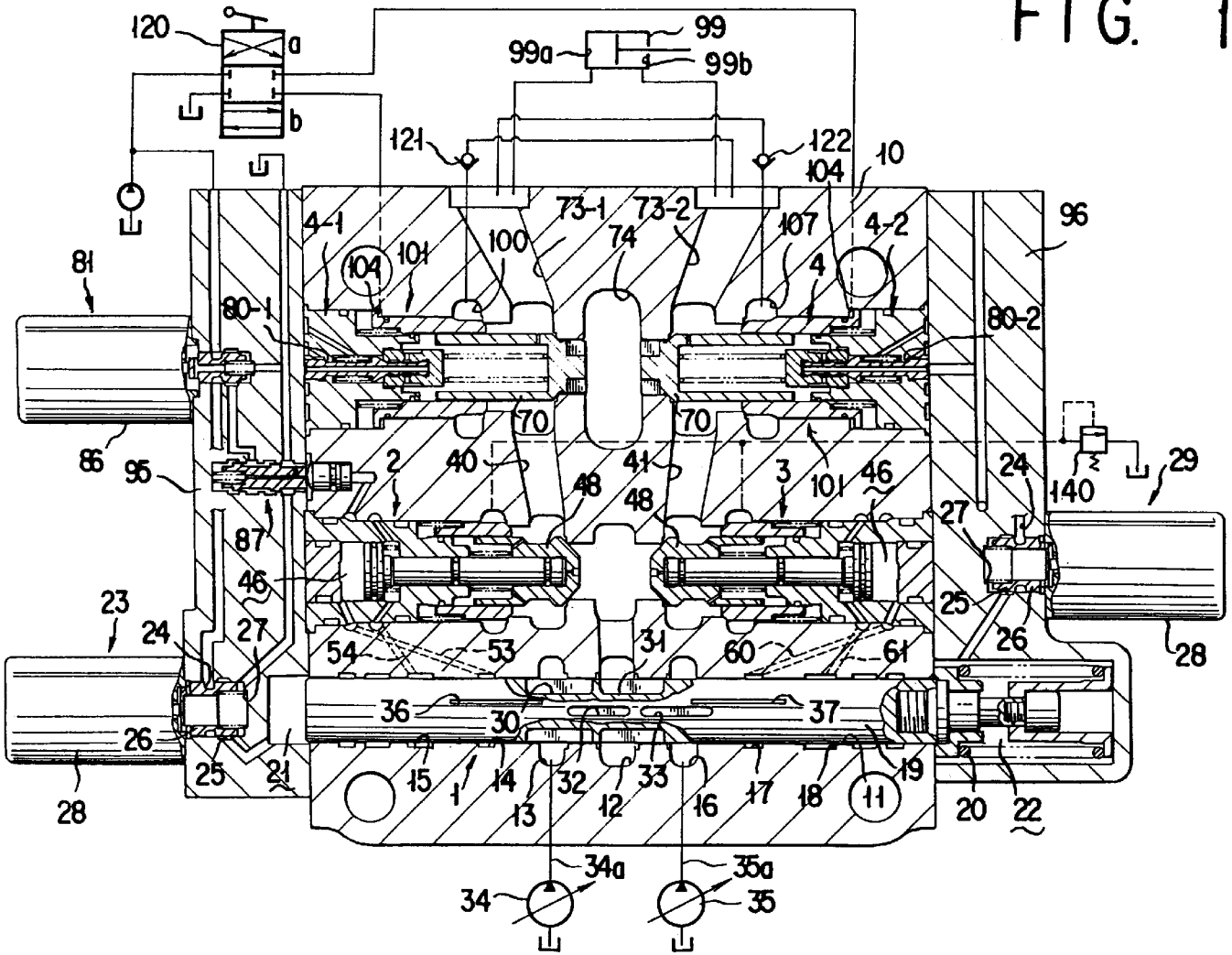
FIG. 1 is an entire cross sectional illustrating a first form of embodiment of the present invention.

Referring first to FIG. 1, a directional control valve is shown as comprising a meter-in flow control valve 1, a first load checking valve 2, a second load checking valve 3 and a meter-out flow control valve 4.

An explanation will now be given of a specific structure of each of the valves.

Meter-in Flow Control Valve

Figure 2:
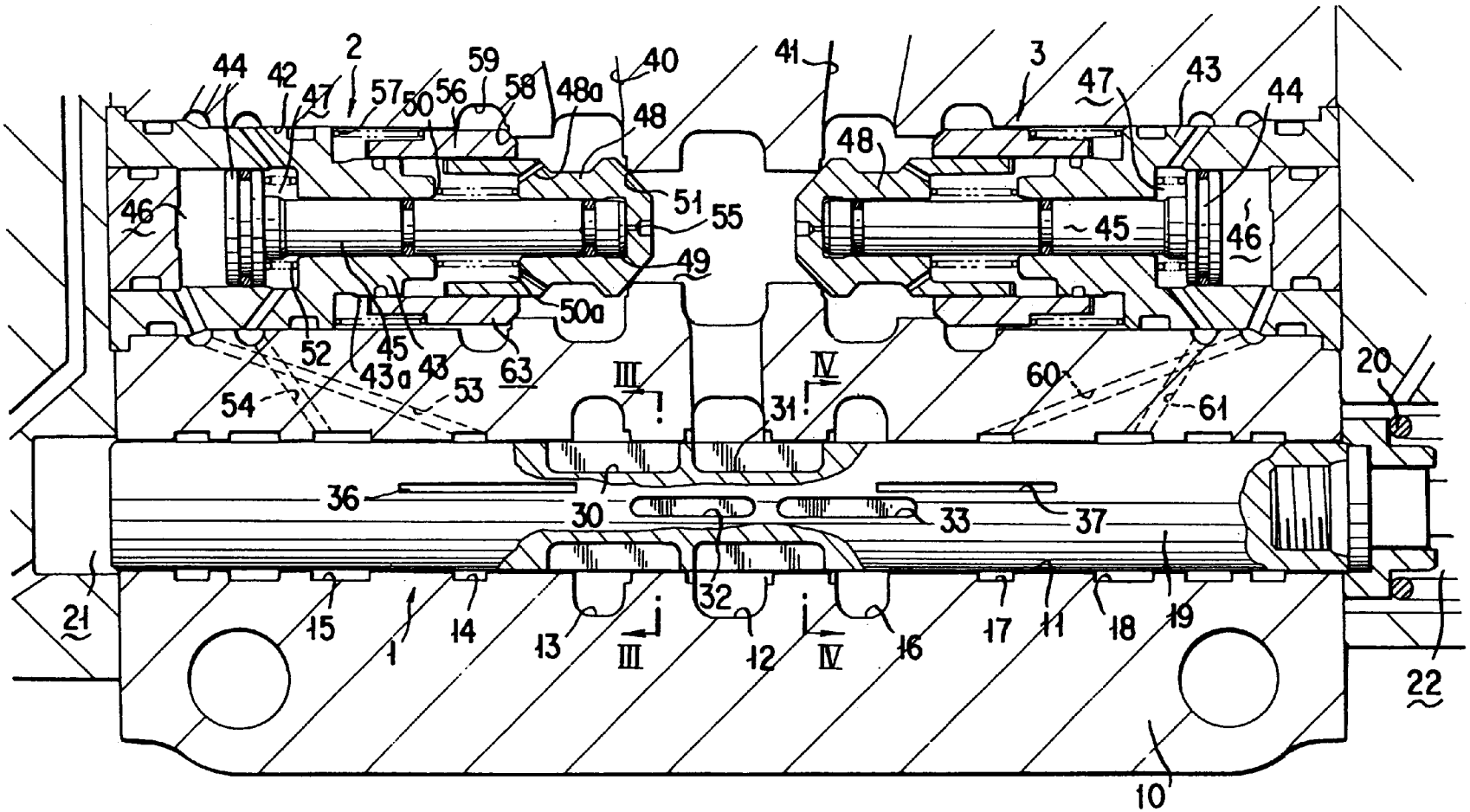
FIG. 2 is an enlarged cross sectional view of a meter-in flow control valve and a first and a second load checking valve.

As shown in FIGS. 1 and 2, a valve body 10 is formed with a meter-in spool bore 11 and also formed with an outlet port 12 that is open to the meter-in spool bore 11. There are also formed in the valve body: on the right left hand side of the outlet port 12 a first pump port 13, a first pilot port 14 and a first tank port 15 and on the right hand side of the outlet port 12 a second pump port 16, a second pilot port 17 and a second tank port 18.

A meter-in spool 19 is arranged to be held at its neutral position by a spring 20, to move to take its first position with pressure fluid supplied into a first pressure receiving chamber 21 and to move to take its second position with pressure fluid supplied into a second pressure receiving chamber 22.

Pressure fluid is supplied into the first pressure receiving chamber 21 through a first meter-in electromagnetic proportional pressure control valve 23. The first meter-in electromagnetic proportional pressure control valve 23 includes a valve 26 for establishing and blocking fluid communication between an inlet port 24 and an outlet port 25, a spring 27 for urging the valve 26 into its fluid blocking position, and a proportional solenoid 28 energizable to drive the valve 26 to take its fluid communication position. The first meter-in electromagnetic proportional pressure control valve is thus designed to provide at the outlet port 25 a pressure that is proportional to a magnitude of electric current passing through the proportional solenoid 27. The outlet port 25 lies in. fluid communication with the first pressure receiving chamber 21.

The second pressure receiving chamber 22 is supplied with pressure fluid through a second meter-in electromagnetic proportional pressure control valve 29. The second electromagnetic proportional pressure control valve 29 is like in structure the first meter-in electromagnetic proportional pressure control valve 23, and has an outlet port 25 lying in fluid communication with the second pressure receiving chamber 22.

Figure 3:
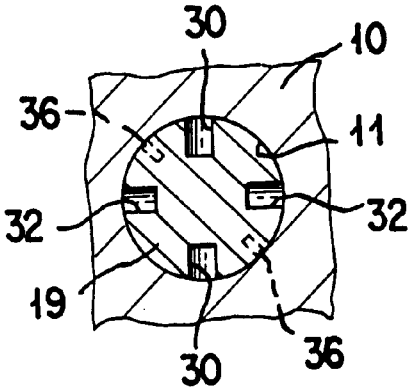
FIG. 3 is a cross sectional view taken along the line III—III in FIG. 2.
Figure 4:
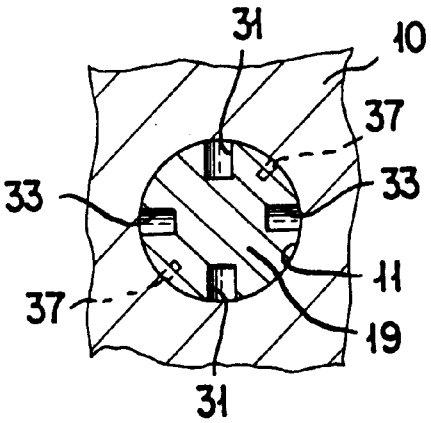
FIG. 4 is a cross sectional view taken along the line IV—IV in FIG. 2.

The meter-in spool 19 is formed with a first and a second main slit channel 30 and 31 and a third and a fourth main slit channel 32 and 33 for establishing and blocking fluid communication between the pump ports 13 and 16 and the outlet port 12. These main slit channels deviate circumferentially in position as shown in FIGS. 3 and 4. The first and second main slit channels 31 and 32 are longitudinally deviated in position while the third and fourth main slit channels 33 and 34 are longitudinally deviated in position.

Figure 7:
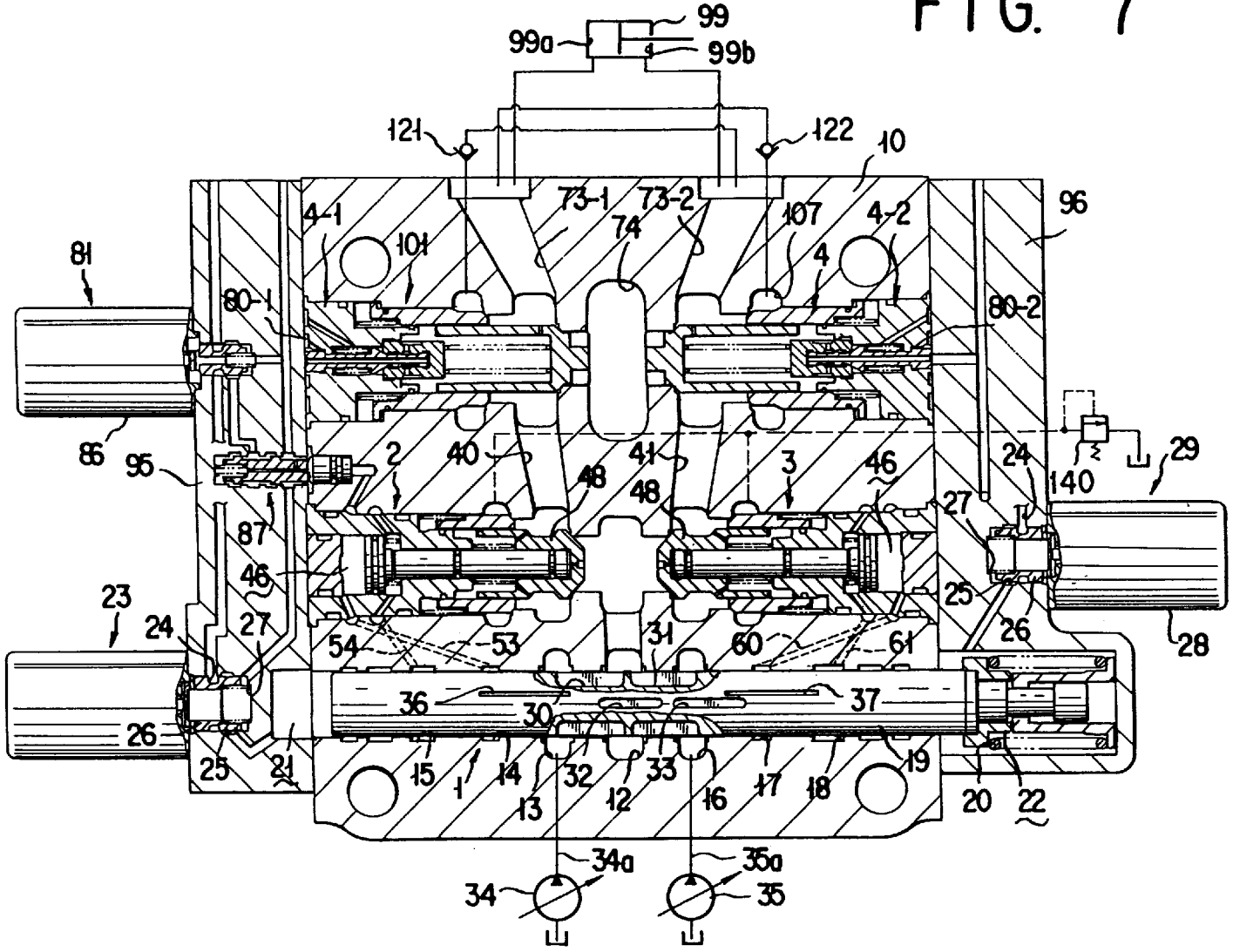
FIG. 7 is a view to aid in describing an operation of the valve system shown in which each of the spools is assumed to take its first position.
Figure 8:
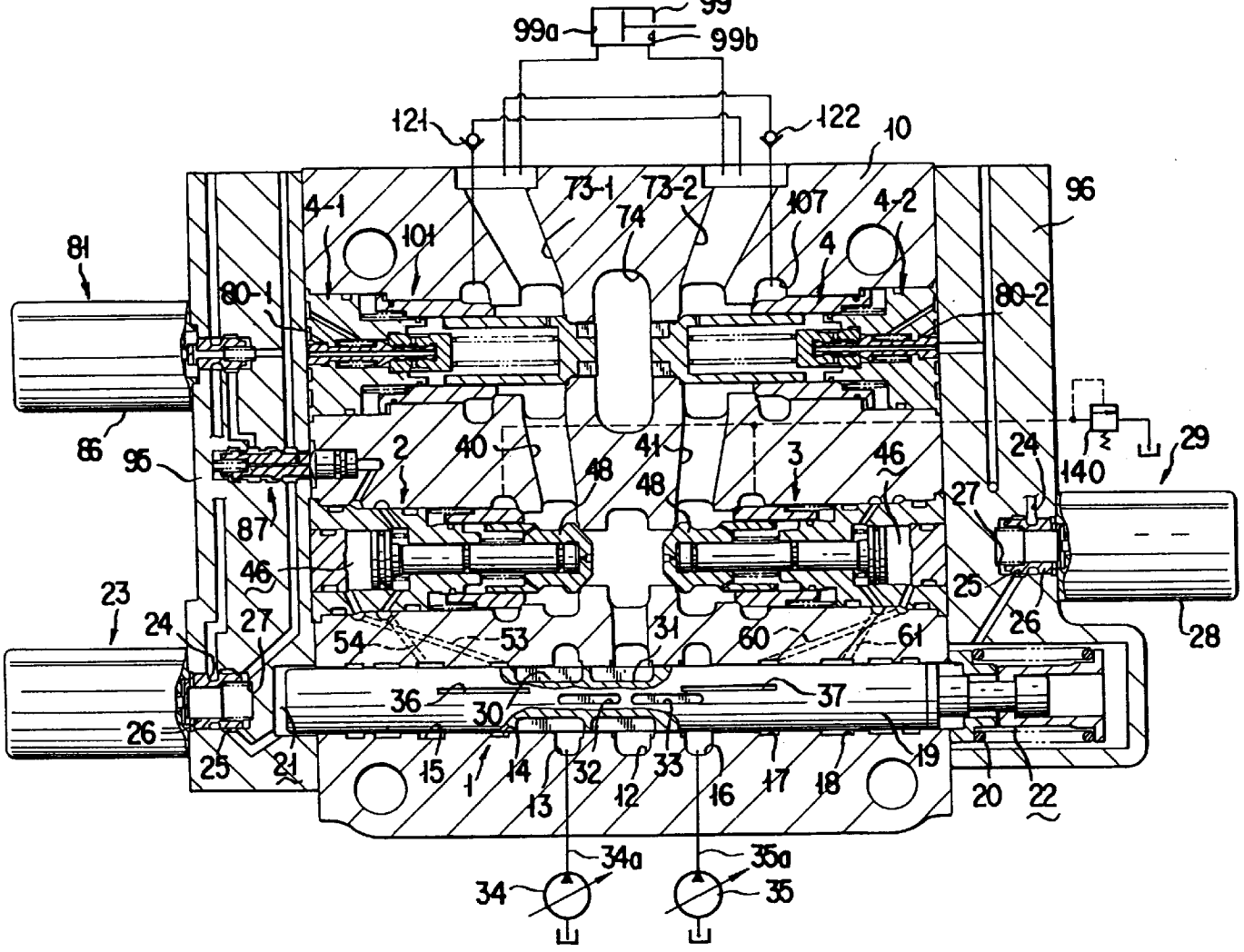
FIG. 8 is a view to aid in describing an operation of the valve system shown in which each of the spools is assumed to take its second position.

Assuming that the meter-in spool 19 lies at its neutral position as shown in FIG. 1, fluid communication will be blocked between the first pump port 13, the second pump port 16 and the outlet port 12. If the meter-in spool 19 is moved to take its first position as shown in FIG. 7, fluid communication will be established between the first pump port 13 and the outlet port 12 via the first main slit channel 30 and also between the second pump port 16 and the outlet port 12 via the second main slit channel 31. If the meter-in spool 19 is moved to take its second position as shown in FIG. 8, fluid communication will be established between the first pump port 13 and the outlet port 12 via the third main slit channel 32 and also between the second pump port 16 and the outlet port 12 via the fourth main slit channel 33.

Using the meter-in spool 19 moving to take its first, second position to establish fluid communication of the first pump port 13, the second pump port 16 with the outlet port 12 in this manner will permit a fluid flow rate that is twice as large as permitted by the conventional valve to be fed into the outlet port 12.

It is also possible to connect, as shown in FIG. 1, the discharge path 34*a* of a first hydraulic pump 34 to the first pump port 13 and the discharge path 35*a* of a second hydraulic pump 35 to the second pump port 16, thereby combining discharge pressure fluids from the first and second hydraulic pumps 34 and 35 for feeding into the outlet port 12. Also, both the first and second pump ports may be fed with a discharge fluid of a single hydraulic pump.

The meter-in spool 19 is also formed with a first pilot slit channel 36 and a second pilot slit channel 37. If the meter-in spool 19 lies at its neutral position as shown in FIG. 1, fluid communication will thus be established also of the first pump port 13 with the first pilot port 14 via the first pilot slit channel 36 and of the second pump port 16 with the second pilot port 17 through the second pilot slit channel 37.

If the meter-in spool 19 is moved to take its first position as shown in FIG. 7, the first pilot slit channel 36 will continue the first pump port 13 to lie in fluid communication with the first pilot port 14 and the second pilot slit channel 37 will bring the second pilot port 17 in fluid communication with the second tank port 18.

If the meter-in spool 19 is moved to take its second position as shown in FIG. 8, the first pilot slit channel 36 will bring the first pilot port 14 and the first tank port 15 into fluid communication with each other and the second slit channel 37 will continue the second pump port 16 and the second pilot port 17 to lie in fluid communication with each other.

First Load Checking Valve and Second Load Checking Valve

As shown in FIG. 2, the valve body 10 is also formed with a first fluid passage 40 and a second fluid passage 41 that lie in fluid communication with the outlet port 12. The first and second load checking valves 2 and 3 are arranged in the first and second fluid passages 40 and 41, respectively.

Structure of the First Load Checking Valve

A sleeve 43 is inserted into and securely fitted with a mounting bore 42 formed in the valve body 10. A rod 45 having a piston 44 is slidably received in the sleeve 43 along its axial center to form a large and a small diameter chamber 46 and 47. A portion of the rod 45 that extends beyond the sleeve 43 has a poppet valve 48 fitted therewith to form a pressure chamber 49. The poppet 48 is held in a pressure contact with a main seat 51 by a spring 50. The rod 45 is urged by a spring 52 toward the large diameter chamber 46 (in a direction away from the poppet valve 48).

The large diameter chamber 46 lies in fluid communication with the first pilot port 14 via a first fluid bore 53. The small diameter chamber 47 lies in fluid communication with the first tank port 15 via a second fluid bore 54. The pressure chamber 49 lies in fluid communication with the outlet port 12 via a fluid bore 55.

A cylindrical valve 56 is fitted over a small diameter area 43*a* of the sleeve 43 and a peripheral surface of the poppet valve 48. The cylindrical valve 56 is urged by a spring 57 into a pressure contact with a seat 58 to block fluid communication between a relief port 59 and the first fluid passage 40. The cylindrical valve 56 pressed by pressure fluid in the first fluid passage 40 acts to establish fluid communication between the relief port 59 and the first fluid passage 40. A check valve 63 for a relief valve is thereby formed.

Structure of Second Load Checking Valve

The second load checking valve 3 is like the first load checking valve 2 in structure and has a large diameter chamber 46 in fluid communication through a third fluid bore 60 with the second pilot port 17 and a small diameter chamber 47 in fluid communication through a fourth fluid bore 61 with the second tank port 18.

Figure 6:
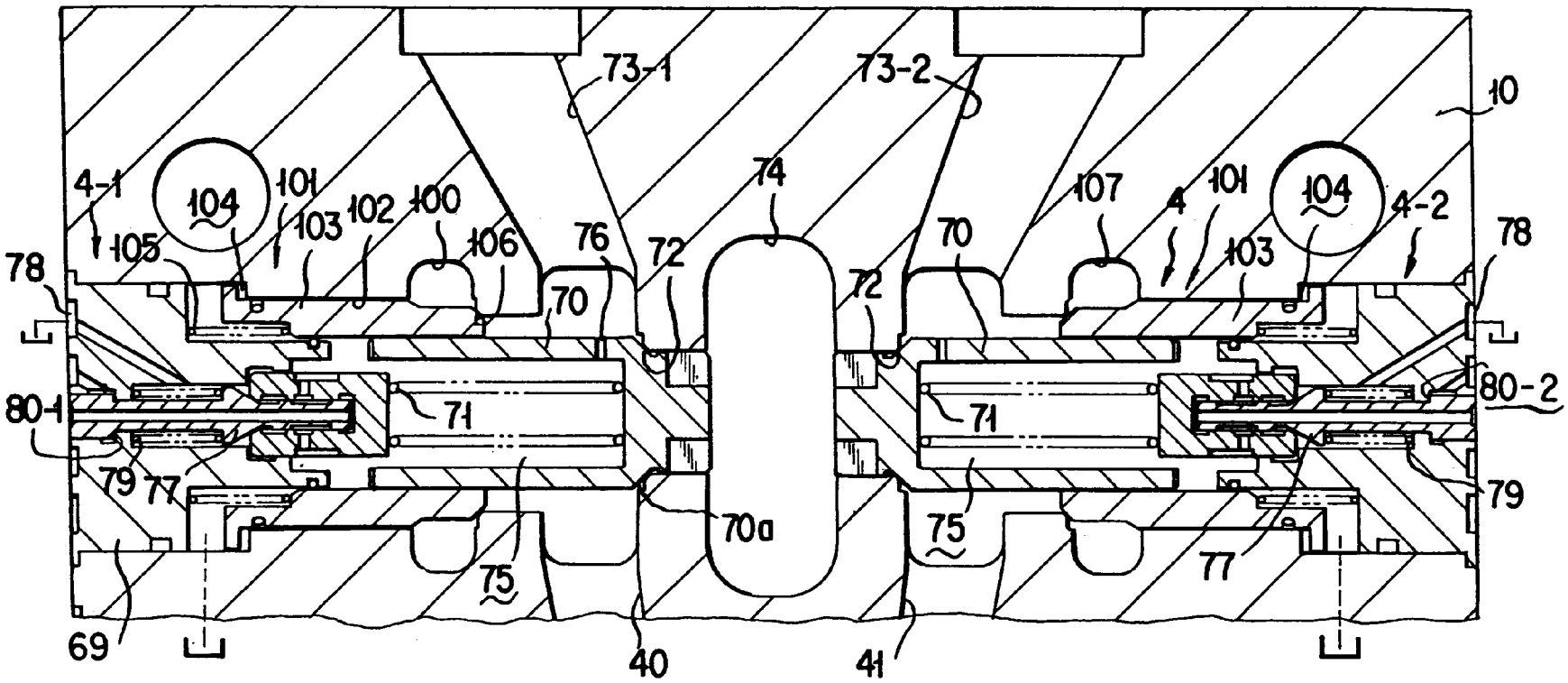
FIG. 6 is a cross sectional view of a meter-out flow control valve.

As shown in FIG. 6, the meter-out flow control valve 4 comprises a first meter-out flow control valve 4-2 and a second meter-out flow control valve 4-2.

The first meter-out flow control valve 4-1 has a poppet valve 70 urged by a spring 71 in a pressure contact with a seat 72 to block fluid communication of the first actuator port 73-1 continuous with a first fluid passage 40 with the tank port 74. It should be noted that the first actuator port 73-1 and the tank port 74 may communicate with each other via a small bore, thereby providing an intake, a suction or an entrainment function. The poppet valve 70 has a spring chamber 75 that communicates via a constriction 76 with the first actuator port 73-1. An auxiliary poppet valve 77 is provided in a sleeve 69 to establish and block fluid communication of the spring chamber 75 with the tank port 78.

The auxiliary poppet valve 77 is urged by an auxiliary spring 79 to take its blocking position and is movable by pressure fluid in a first pressure receiving chamber 80-1 to take its fluid communication position.

In the arrangement described, the absence of pressure fluid admitted into the first pressure receiving chamber 80-1 will block fluid communication between the spring chamber 75 and the tank port 78. The spring chamber 75 will then have a pressure identical to that in the actuator port 73-1 to allow the poppet valve 70 to be pushed by the spring 71 against the seat 72 and thereby to be closed. Accordingly, the poppet valve 70 will be held in a closed state under a hold-on pressure acting inside the first actuator port 73-1 and the hold-on pressure will not leak into the tank port 74.

If pressure fluid is admitted into the first pressure chamber 80-1, the poppet valve 77 will be moved to take its fluid communication position to permit the spring chamber 75 to communicate with the tank port 78. Pressure fluid in the actuator port 73-1 will flow through the constriction 76 and the spring chamber 75 into the tank port 78 and the pressure in the spring chamber 75 will be reduced to be lower than that in the actuator port 73-1.

The poppet valve 70 will then be moved away from the seat 72 under pressure in the first actuator port 73-1 acting on a pressure receiving area 70*a* of the poppet valve 70 to bring the first actuator port 73-1 into fluid communication with the tank port 74. The area of this fluid communication will be proportional to the stroke distance of the poppet valve 77 and hence, the pressure in the first pressure receiving chamber 80-1.

It should also be noted that if the pressure in the tank port 74 becomes greater than the pressure in the first actuator port 73-1, the poppet valve 70 will be moved against the spring 71 to move away from the seat 72. Thus, the poppet valve 70 will be open when the pressure in the first actuator port 73-1 becomes negative. Capable of drawing pressure fluid into the tank port 74, the poppet valve 70 will then have an intake, suction or entrainment function.

The second meter-out flow control valve 4-2 is like in structure the first meter-out flow control valve 4-1 and acts to establish and block fluid communication between the second actuator port 73-2 that is continuous with the second fluid passage 41 and the tank port 74. It performs the switching operation with the pressure in a second pressure receiving chamber 80-2.

Arranged coaxially with the first meter-out flow control valve 4-1, a regenerative switching valve 101 is provided for establishing and blocking fluid communication between the first actuator port 73-1 and a first regenerative port 100. Specifically, a cylindrical valve. 103 is slidably fitted in a space bounded by a bore 102 in the valve body 10, the sleeve 69 and the poppet valve 70 to define a pressure chamber 104 with the bore 102 of the valve body 10.

The cylindrical valve 103 is urged by a spring 105 into a pressure contact with a seat 106 of the valve body 10 to block fluid communication between the first actuator port 73-1 and the first regenerative port 100. If the pressure chamber 104 is supplied with pressure fluid, the cylindrical chamber 103 will be moved against the spring 105 to move to establish fluid communication between the first actuator port 73-1 and the first regenerative port 100.

Arranged coaxially with the second meter-out flow control valve 4-2, a regenerative switching valve 101 is provided for establishing and blocking fluid communication between the second actuator port 73-2 and a second regenerative port 107.

Figure 5:
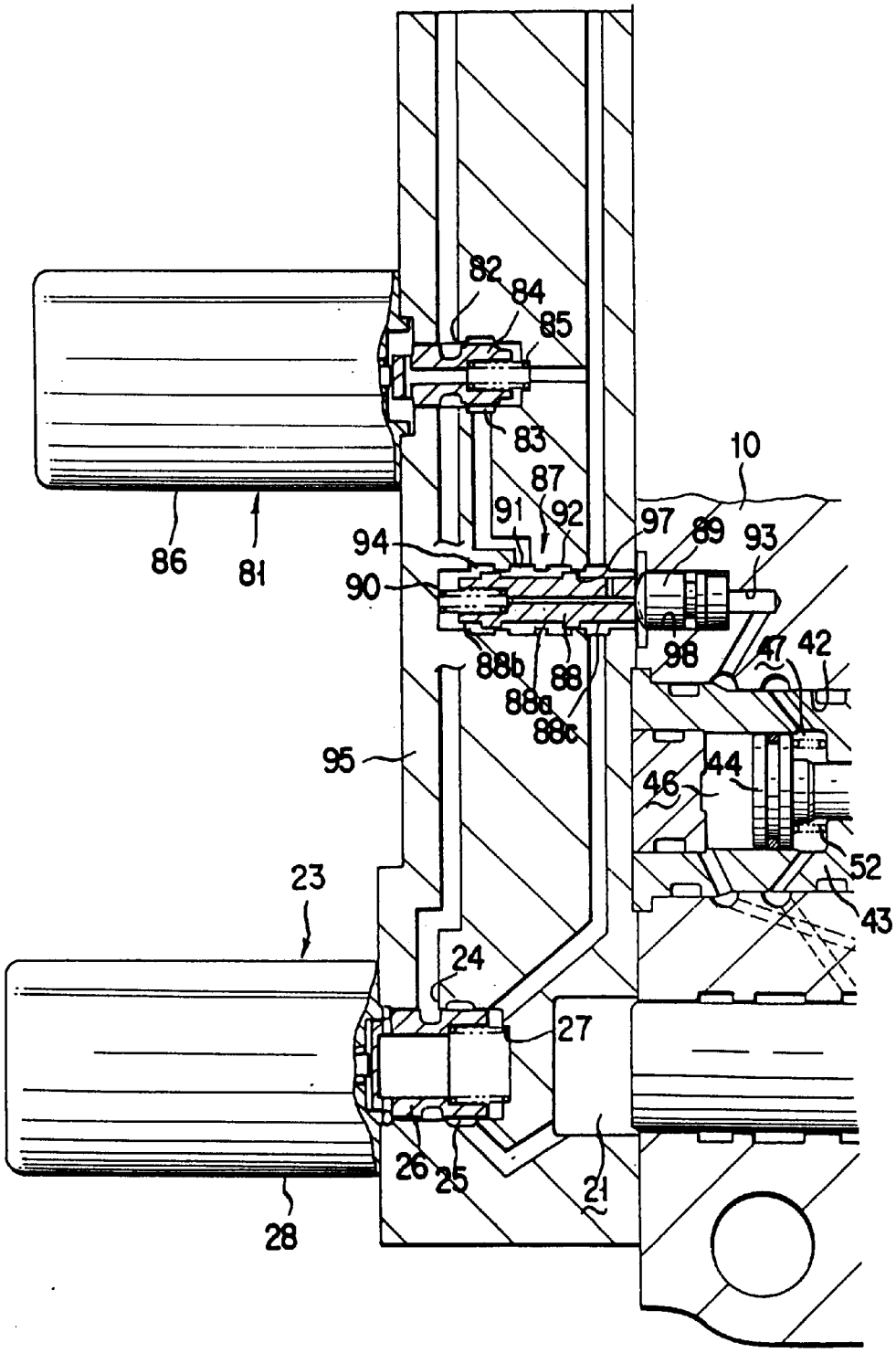
FIG. 5 is a cross sectional view of a pilot switching valve.

An electromagnetic proportional pressure control valve 81 for supplying the first and second pressure receiving chambers 80-1 and 80-2 with pressure fluid is shown in FIG. 5 as comprising a spool 84 for establishing and blocking fluid communication between an inlet port 82 and an outlet port 83, a spring 85 for holding the spool 84 at a position that blocks fluid communication between the inlet port 82 and the outlet port 83, and a proportional solenoid 86 energizable to move the spool 84 to take its fluid communication position between the inlet port 82 and the outlet port 83.

A pilot switching valve 87 is provided to feed pressure fluid in the outlet port 83 into one of the first and second pressure receiving chambers 80-1 and 80-2.

The pilot switching valve 87 is shown in FIG. 5 provided with a first spool 88 and a second spool 89. The first spool 88 is movable by a spring 90 to take its first position to permit an inflow port 91 to communicate with a first outflow port 92 through a first small diameter area 88*a* and a second outflow port 94 with the tank port through a second small diameter area 88*b*. Then, the second spool 89 will be pushed to move by the first spool 88. The second spool 89 will be pushed with pressure fluid in a pressure chamber 93 to move the first spool 88 to take its second position that allow the inflow port 91 to communicate with the second outflow port 94 through the first small diameter area 88*a* and the first outflow port 92 with the tank port through a small diameter area 88*c*.

There are fluid communications between the inflow port 91 and the outlet port 83, between the first outflow port 92 and the second pressure receiving chamber 80-2, and between the pressure chamber 93 and the large diameter chamber 46 in the first load checking valve 2 and hence with the first pilot port 14, respectively.

Each of the previously mentioned electromagnetic proportional pressure valves is attached to a first cover 95 and/or a second cover 96 attached to the valve body 10. The first spool 88 in the pilot switching valve 87 is inserted into and fitted with a spool bore 97 in the first cover 95, and the second spool 89 is inserted into and fitted with a spool bore 98 in the valve body 10.

There are fluid communications between the first actuator port 73-1 and a first chamber 99*a* of a hydraulic actuator 99 and between the second actuator port 73-2 and a second-chamber 99*b* of it, respectively.

An explanation Will now be given of an operation of the valve system whose construction has been described so far. Where the Electromagnetic Proportional Valves 23, 29 and 81 are All Deactuated Then, the meter-in spool 19 will take its neutral position as shown in FIG. 1. Each of the poppet valves 70 in the first and second meter-out flow control valves 4-1 and 4-2 will be in a closed state. Pressure fluid admitted into the first pump port 13 will be allowed to flow through the first pilot slit channel 36, the first pilot port 14 and the first fluid bore 53 into the large diameter chamber 46 to move the piston 44 and hence the rod 45 rightwards, causing the poppet valve 48 to pushed against the seat 51 to hold the first load checking valve 2 in a closed state.

With pressure in the first actuator port 73-1 being applied through the small bore 48*a* into the spring chamber 50*a* and thus acting to press the poppet valve 48 against the seat 51, the first load checking valve 2 will be held closed under a hold-on pressure. in the first chamber 99*a* of the hydraulic actuator 99. This will prevent any leakage of the hold-on pressure that is an elevated pressure.

Also, pressure fluid admitted into the second pump port 16 will be allowed to flow into the large diameter chamber 46 in the second load checking valve 3. This pressure fluid pressing the poppet valve 48 against the seat 51, the second load checking valve 3 will be held in a closed state while a hold-on pressure in the second chamber 99*b* of the hydraulic actuator 99 is also acting to hold the second load checking valve 3 to be closed. This will prevent any leakage of the hold-on pressure that is an elevated pressure.

Where the First Meter-in Electromagnetic Pressure Control Valve 28 and the Meter-out Electromagnetic Pressure Control Valve 81 are being Actuated Referring to FIG. 7, pressure fluid admitted into the first pressure receiving chamber 21 of the meter-in flow control valve 1 will cause the meter-in spool 19 to take its first position. Pressure fluid in the pressure chamber 93 will allow the first spool 88 in the pilot switching valve 87 to take its second position. Output pressure fluid of the meter-out electromagnetic pressure control valve 81 that is admitted through the second outflow port 94 into the first pressure receiving chamber 80-1 of the first meter-out flow control valve 4-1 will move the auxiliary poppet valve 77 and bring the poppet valve 70 into an open state.

The first load checking valve 2 will be brought into a closed state thereby as mentioned previously. The large diameter chamber 46 of the second load checking valve 3 will then be allowed to communicate through the third fluid bore 60, the second pilot port 17, the second pilot slit channel 37 and the second tank port 18 with the reservoir tank. This will cause the piston 44 and hence the rod 45 to be moved by the spring 52 to move away from the poppet valve 48, thus bringing the second load checking valve 3 into an open state in which the poppet valve 48 .is open and operates under pressure fluid.

Consequently, pressure fluid in the outlet port 12 will push the poppet valve 48 of the second load checking valve 3 to cause it to move away from the seat 51 and will flow through the second fluid passage 41 and the second actuator port 73-2 into the second chamber 99*b* of the hydraulic actuator 99. And, pressure fluid in the first chamber 99*a* will flow out through the first actuator port 73-1 and the tank port 74 into the reservoir tank.

Where the Second Meter-in Electromagnetic Proportional Pressure Control Valve 29 and the Meter-out Electromagnetic Proportional Pressure Control Valve 81 are being Actuated Referring to FIG. 8, pressure fluid admitted into the second pressure receiving chamber 22 of the meter-in flow control valve 1 will cause the meter-in spool 19 to take its second position. The first spool 88 of the pilot switching valve 87 urged by the spring 90 will have its first position, and output pressure fluid of the meter-out electromagnetic pressure control valve 81 that is admitted through the first outflow port 92 into the second pressure receiving chamber 80-2 of the second meter-out flow control valve 4-2 will move the auxiliary poppet valve 77 and bring the poppet valve 70 into an open state.

The second load checking valve 3 will thereby be brought into a closed state as mentioned previously. The large diameter chamber 46 of the first load checking valve 2 will then be allowed to communicate through the first fluid bore 53, the first pilot port 14, the first pilot slit channel 36 and the first tank port 15 with the reservoir tank. This will cause the piston 44 and hence the rod 45 to be moved by the spring 52 to move away from the poppet valve 48, thus bringing the first load checking valve 2 into an open state in which the poppet valve 48 is open and operates under pressure fluid.

Consequently, pressure fluid in the outlet port 12 will push the poppet valve 48 of the second load checking valve 2 to cause it to move away from the seat 51 and will flow through the first fluid passage 40 and the first actuator port 73-1 into the first chamber 99*a* of the hydraulic actuator 99. And, pressure fluid in the second chamber 99*b* will flow out through the second actuator port 73-2 and the tank port 74 into the reservoir tank.

In the operation described, pressure fluid in the first actuator port 73-1, second actuator port 73-2 pushing the cylindrical valve 56 will act through the relief port 59 onto the relief valve 140 and will perform a relief operation when the pressure of the fluid comes to be greater than the preset pressure for the relief valve 140.

Also, pressure fluid in the relief port 59 urging the cylindrical valve 56 into pressure contact with the seat 58 will block fluid communication between the first, second actuator port 73-1, 73-2 and the relief port 59, thus preventing pressure fluid in the relief port 59 from flowing into the first, second actuator port 73-1, 73-2.

In this manner, the relief valve 140 can prevent pressure in the first, second actuator port 73-1, 73-2 from rising abnormally.

As mentioned before, when the meter-in spool 19 lies at its first position and pressure fluid is thus supplied into the second actuator port 73-2, supplying pressure fluid into the pressure chamber 104 of the regenerative switching valve 101 to establish fluid communication between the first actuator port 73-1 and the first regenerative port 100 will allow return fluid admitted into the first actuator port 731 to flow into the first regenerative port 100.

Also, as mentioned before, when the meter-in spool 19 lies at its second position and pressure fluid is thus supplied into the first actuator port 73-1, supplying pressure fluid into the pressure chamber 104 of the regenerative switching valve 101 to establish fluid communication between the second actuator port 73-2 and the second regenerative port 107 will allow return fluid admitted into the second actuator port 73-2 to flow into the second regenerative port 107.

There is also included in the valve system an operating valve 120 as shown in FIG. 1 for use in introducing pressure fluid into the pressure chamber 104 of the regenerative switching valve 101. The operating valve 120 is switchable to take a first position a or a second position b to provide the regenerative valve 101 with an external pilot pressure.

Fluid communications may also be established between the first pressure receiving chamber 80-1 and the pressure chamber 104 and between the second pressure chamber 80-2 and the pressure chamber 104, respectively, to permit a switching pilot pressure of the meter-out flow control valve to be utilized.

Method of recycling a return fluid that is recovered in a manner as so far described may involve, as shown in FIG. 1, connecting the first regenerative port 100 via a check valve 121 to the second meter-out port 73-2, and connecting the second regenerative port 107 via a check valve 122 to the first meter port 73-1 to supply the return fluid recovered from one of the actuator ports into the other actuator port.

Figure 9:
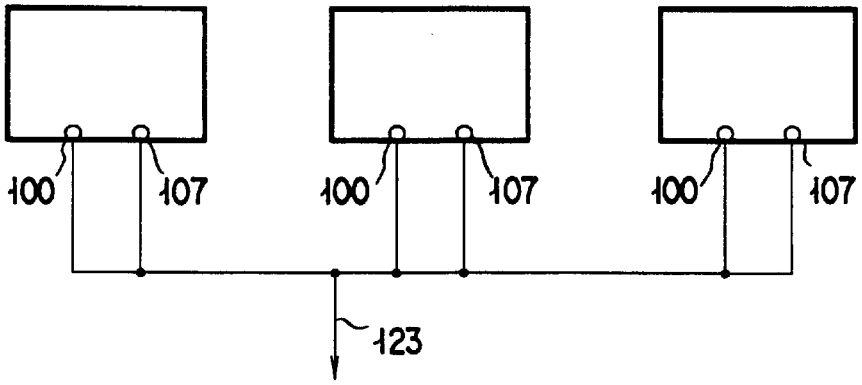
FIG. 9 is a cross sectional view showing an example of utilization of pressure fluid regenerated.
Figure 10:
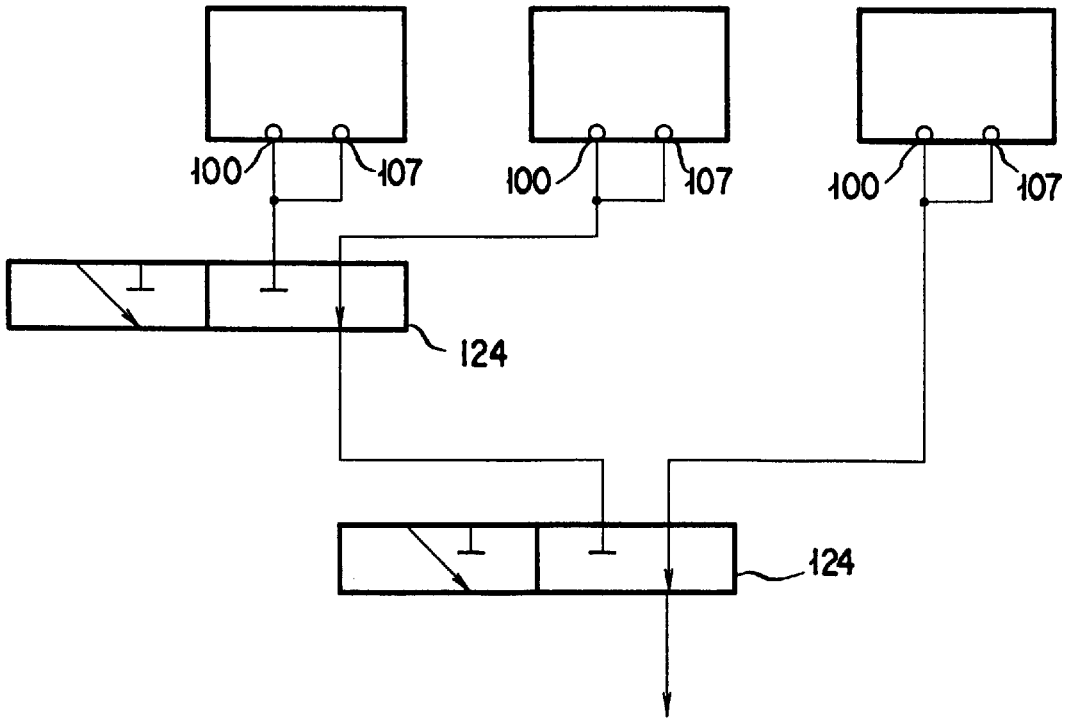
FIG. 10 is a cross sectional view showing another example of utilization of pressure fluid regenerated.

Also, for an application that entails a plurality of directional control valves, as shown in FIG. 9, the regenerative ports in these systems may be combined into a single circuit 123, or as shown in FIG. 10, a selector switching valve 124 may be employed to permit a return fluid from any regenerative port as desired to be selected for recycling.

An explanation will next be given of a second form of embodiment of the meter-out flow control valve 4.

Figure 11:
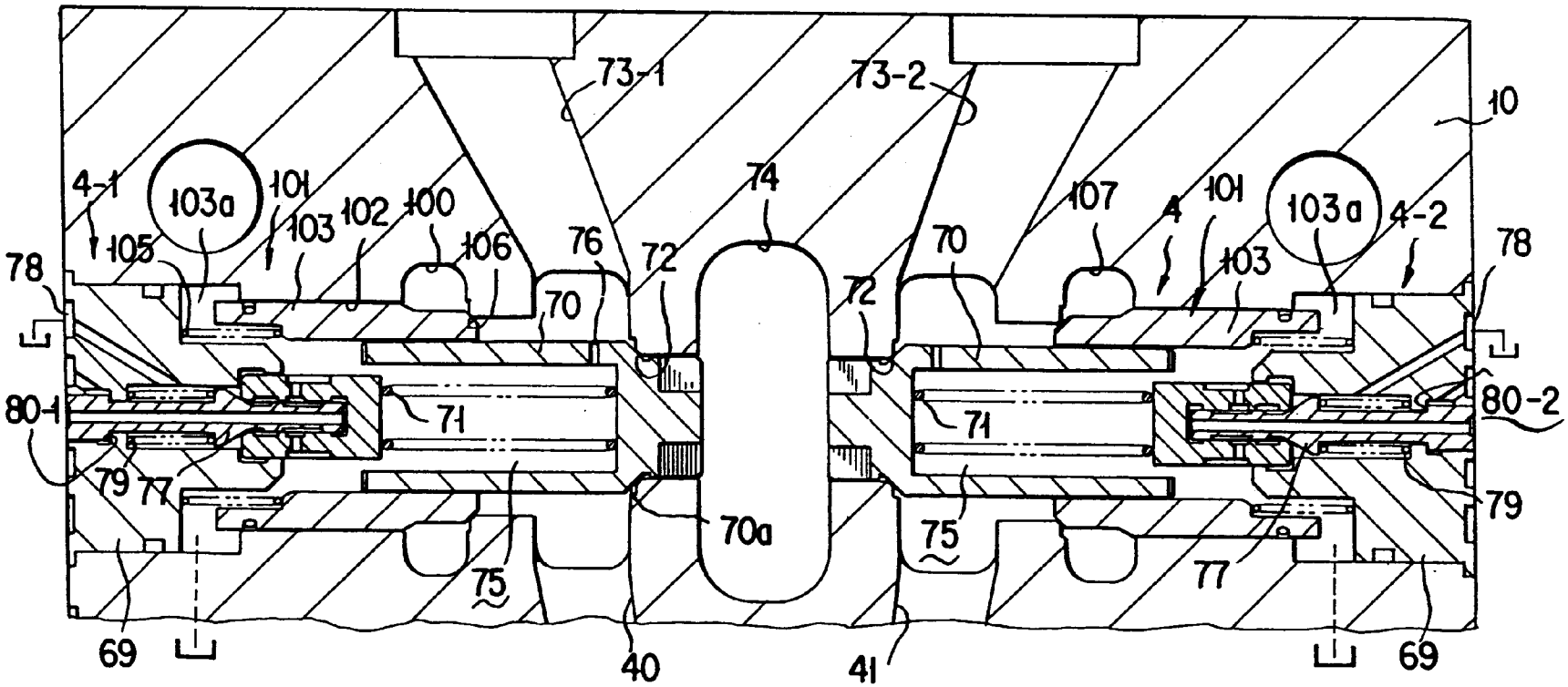
FIG. 11 is a cross sectional view illustrating a second form of embodiment of the meter-out flow control valve.

Referring to FIG. 11, fluid communication is established between the poppet valve 70 in the first meter-out flow control valve 4-1 and the spring chamber 103*a* of the cylindrical valve 103. This permitting the cylindrical valve 103 to be pushed by pressure fluid in the first actuator port 73-1 and forced thereby against the seat 106 can prevent a hold-on pressure in the first actuator port 73-1 from leaking into the first regenerative port 100.

Also, furnishing the first pressure receiving chamber 80-1 with pressure fluid and thereby permitting the poppet valve 70 to be open and operate will reduce the pressure in the spring chamber 103*a* in the cylindrical valve 103 as well. This will permit the cylindrical valve 103 to be moved under pressure in the first actuator port 73-1 to establish fluid communication between the first actuator port 73-1 and the first regenerative port 100.

The second meter-out flow control valve 4-2 is likewise constructed and arranged to operate.

An explanation will next be given of a third form of embodiment of the meter-out flow control valve 4.

Figure 12:
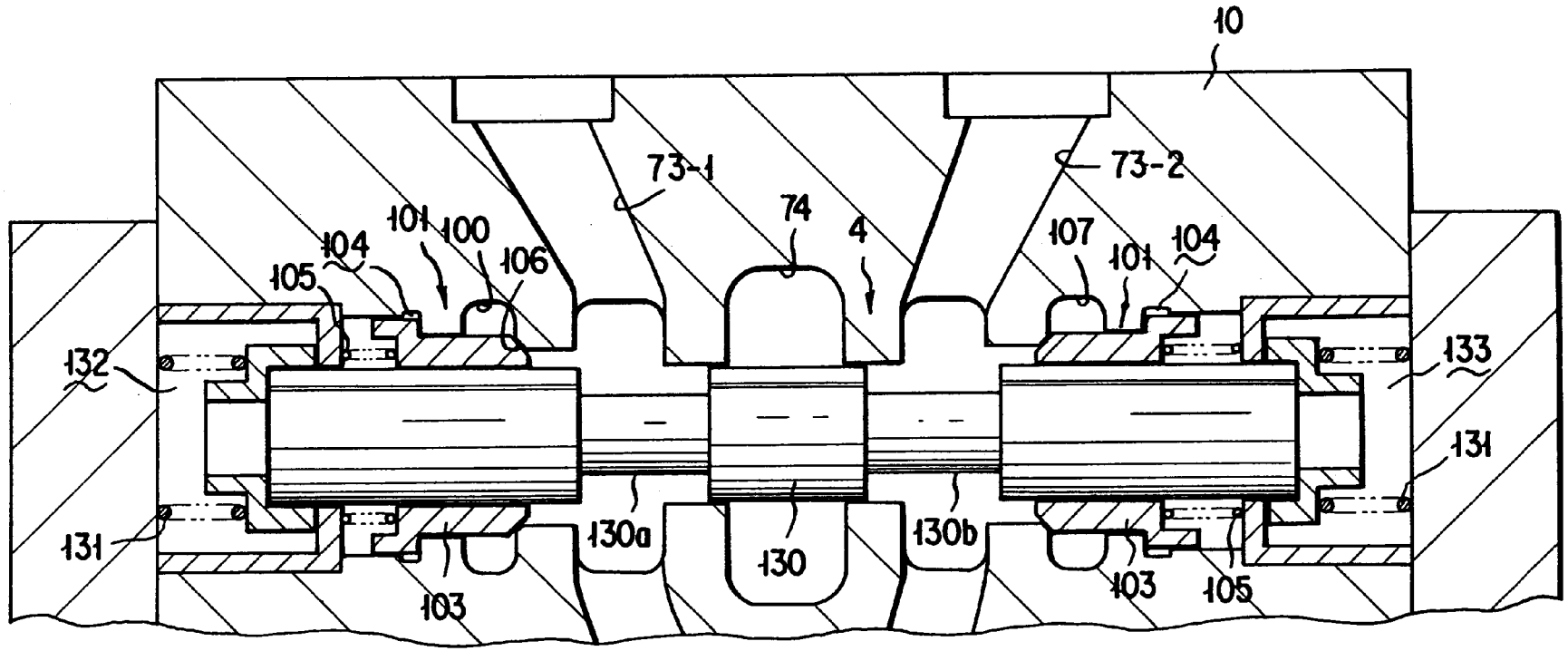
FIG. 12 is a cross sectional view illustrating a third form of embodiment of the meter-out flow control valve.

Referring to FIG. 12, a meter-out spool 130 is held at its fluid blocking position by a spring 131 to block fluid communication between each of the first and second actuator ports 73-1 and 73-2 and the tank port 74.

Turning the meter-out spool 130 to its first position by supplying the first pressure receiving chamber 132 will permit the first actuator port 73-1 to communicate via a first small diameter area 130*a* with the tank port 74. Turning the meter-out spool 130 to its second position by supplying the second pressure receiving chamber 133 with pressure fluid will permit the s econd actuator port 73-2 to communicate via a s econd small diameter area with the tank port 74.

A pair of regenerative switching valves 101 are provided in which a pair of cylindrical valves 103 are fitted with the meter-out spool 130 to form a pair of pressure chambers 104.

Thus, furnishing one of the pressure chambers 104 with pressure fluid will cause one of the cylindrical valve 103 to be moved against a spring 105 to permit the first actuator port 73-1 and the first regenerative port 100 to communicate with each other. Furnishing the other pressure chamber 104 with pressure fluid will cause the other cylindrical valve 103 to be moved against a spring 105 to permit the second actuator port 73-2 and the second regenerative port 107 to communicate with each other.

Figure 13:
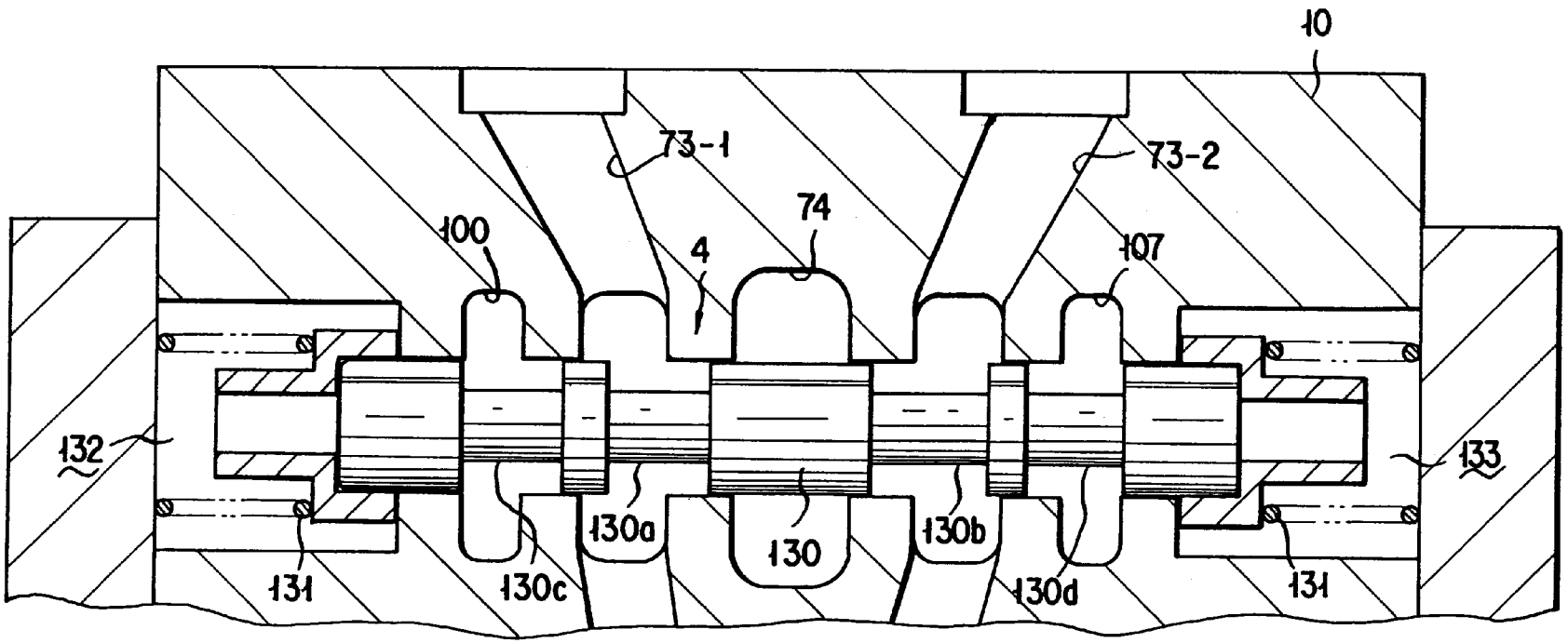
FIG. 13 is a cross sectional view illustrating a fourth form of embodiment of the meter-out flow control valve.

FIG. 13 shows a fourth form of embodiment of the meter-out flow control valve 4 in which the meter-out spool 130 is formed with a third small diameter area 130*c* and a fourth diameter area 130*d*.

When the meter-out spool 130 lies at its fluid blocking position, fluid communication between the first, second actuator port 73-1, 73-2 and the first, second regenerative port 100, 107 will be blocked. When the meter-out 130 lies at its first position, fluid communication between the first actuator port 73-1 and the first regenerative port 100 will be established. When the meter-out spool 130 lies at its second position, fluid communication will be established between the second actuator port 73-2 and the second regenerative 107 will be established.

With the system so constructed and arranged, supplying the first, second pressure port 132, 133 with pressure fluid can regenerate the return fluid from the actuator.

What is claimed is:

1. A meter-out flow control valve characterized in that it comprises:

a first valve for establishing and blocking fluid communication between a first actuator port 73-1 and a tank port 74, the first valve being adapted to be held in its fluid blocking position by a spring 71 and to move to take its fluid communication position in response to an external signal;

a second valve for establishing and blocking fluid communication between a second actuator port 73-2 and the tank port 74, the second valve being adapted to be held in its fluid blocking position by a spring 71 and to move to take its fluid communication position in response to an external signal;

a first regenerative switching valve 101 disposed coaxially with said first valve for establishing and blocking fluid communication between the first actuator port 73-1 and a first regenerative port 100, the first regenerative switching valve 101 being adapted to be normally held in its fluid blocking position and to move to take its fluid communication position in response to an external signal; and a second regenerative switching valve 101 disposed coaxially with said second valve for establishing and blocking fluid communication between the second actuator port 73-2 and a second regenerative port 107, the second regenerative switching valve 101 being adapted to be normally held in its fluid blocking position and to move to take its fluid communication position in response to an external signal.

2. A meter-out flow control valve characterized in that it comprises:

a meter-out spool 130 for establishing and blocking fluid communication between a first, a second actuator port 73-1, 73-2 and a tank port 74, the meter-out spool 130 being adapted to be held in its fluid blocking position by a spring 131 and to move to take a first fluid communication position in response to an external signal for establishing fluid communication between the first actuator port 73-1 and the tank port 74 and to move to take a second fluid communication position in response to an external signal for establishing fluid communication between the second actuator port 73-2 and the tank port 74;

a first regenerative switching valve 101 disposed coaxially with said meter-out spool 130 for establishing and blocking fluid communication between the first actuator port 73-1 and a first regenerative port 100, the first regenerative switching valve 101 being adapted to be normally held in its fluid blocking position and to move to take its fluid communication position in response to an external signal; and a second regenerative switching valve 101 disposed coaxially with said meter-out spool 130 for establishing and blocking fluid communication between the second actuator port 73-2 and a second regenerative port 107, the second regenerative switching valve 101 being adapted to be normally held in its fluid blocking position and to move to take its fluid communication position in response to an external signal.

3. A meter-out flow control valve as set forth in claim 1 or claim 2 in which said regenerative switching valve 101 is arranged so that a cylindrical valve 103 is urged by a spring 105 into a pressure contact with a seat 106 to take its blocking position, the cylindrical valve 103 is movable away from the seat 106 by pressure fluid in a pressure chamber 104, further comprising means for supplying pressure fluid into said pressure chamber 104.

4. A meter-out flow control valve as set forth in claim 1 in which said regenerative switching valve 101 is arranged so that a cylindrical valve 103 is urged by a spring 105 into a pressure contact with a seat 106 to take its blocking position, and is movable to take its fluid communication position in response to an external signal for causing a valve to move to take its fluid communication position.

5. A meter-out flow control valve characterized in that it comprises:

a valve body 10 having a first and a second actuator port 73-1 and 73-2, a tank port 74 and a first and a second regenerative port 100 and 107; and a meter-put spool 130 slidably received in said valve body 10, the meter-out spool 130 being adapted to be held in its fluid blocking position by a spring 131 and to move to take its first fluid communication position in response to an external signal for establishing fluid communication between the first actuator port 73-1 and the tank port 74 and the first regenerative port 100 and to move to take its second fluid communication position in response to an external signal for establishing fluid communication between the second actuator port 73-2 and the tank port 74 and the second regenerative port 107.

6. A directional control valve characterized in that it comprises:

a meter-in flow control valve 1 for establishing and blocking fluid communication of a pump port with a single outlet port 12;

a first load checking valve 2 disposed between said outlet port 12 and a first actuator port 73-1 and adapted to be held in a closed state in response to an external signal;

a second load checking valve 3 disposed between said outlet port 12 and a second actuator port 73-2 and adapted to be held in a closed state in response to an external signal; and a meter-out flow control valve 4 comprising a first meter-out flow control valve 4-1 and a second meter-out flow control valve 4-2, the first meter-out flow control valve 4-1 being of a poppet valve type comprising a poppet valve 70 adapted to block fluid communication between the first actuator port 73-1 and a tank port 74 under pressure in the first actuator port 73-1, said poppet valve 70 being adapted to move in response to an external signal to take its fluid communication position, and a regenerative switching valve 101 disposed on an outer periphery of said poppet valve 70 for establishing and blocking fluid communication between the first actuator port 73-1 and a first regenerative port 100, and said second meter-out flow control valve 4-2 being of a poppet valve type comprising a poppet valve 70 adapted to block fluid communication between the second actuator port 73-2 and the tank port 74 under pressure in the second actuator port 73-2, said poppet valve 70 being adapted to move in response to an external signal to take its fluid communication position, and there being arranged on a periphery of this poppet valve 70 a regenerative switching valve 101 for establishing and blocking fluid communication between the second actuator port 73-2 and a second regenerative port 107.

* * * * *